United States Patent [19]

Suzuki et al.

[11] Patent Number: 4,780,067

[45] Date of Patent: Oct. 25, 1988

[54] MULTICYLINDER ROTARY COMPRESSOR

[75] Inventors: Sou Suzuki; Keiju Sakaino; Katsuyuki Kawasaki; Yoshinori Shirafuji; Hiroshi Ogawa; Hiroyuki Nagashima, all of Shizuoka City, Japan

[73] Assignee: Mitsubishi Denki Kabushiki Kaisha, Japan

[21] Appl. No.: 101,445

[22] Filed: Sep. 28, 1987

[30] Foreign Application Priority Data

Sep. 30, 1986 [JP] Japan ..... 61-232604
Apr. 7, 1987 [JP] Japan ..... 62-85102
Apr. 7, 1987 [JP] Japan ..... 62-85103

[51] Int. Cl.[4] ..... F04B 41/00; F04B 49/00; F04C 23/00; F04C 29/08

[52] U.S. Cl. ..... 417/441; 417/286; 417/295; 417/410; 418/60; 418/84; 418/100

[58] Field of Search ..... 417/286, 292, 295, 440, 417/441, 410; 418/60, 63, 84, 100

[56] References Cited

U.S. PATENT DOCUMENTS

| | | | |
|---|---|---|---|
| 2,286,272 | 6/1942 | Higham | 417/372 |
| 2,350,537 | 6/1944 | Scott | 417/295 X |
| 2,991,002 | 7/1961 | Quertier | 417/295 |
| 3,407,746 | 10/1968 | Johnson | 92/169 X |
| 3,796,515 | 3/1974 | Lindqvist et al. | 417/295 X |
| 4,343,599 | 8/1982 | Kowsokabe | 418/100 X |
| 4,452,570 | 6/1984 | Fujisaki et al. | 417/295 X |
| 4,580,949 | 4/1986 | Maruyama et al. | 417/295 X |
| 4,636,148 | 1/1987 | Takao et al. | 417/295 X |
| 4,642,034 | 2/1987 | Terauchi | 417/295 |

FOREIGN PATENT DOCUMENTS

| | | | |
|---|---|---|---|
| 3540445 | 5/1986 | Fed. Rep. of Germany | 418/60 |
| 142083 | 7/1985 | Japan | 417/295 |
| 4892 | 1/1986 | Japan | 417/295 |

*Primary Examiner*—Carlton R. Croyle
*Assistant Examiner*—Paul F. Neils
*Attorney, Agent, or Firm*—Leydig, Voit & Mayer

[57] ABSTRACT

A multicylinder rotary compressor has a plurality of cylinders housing rolling pistons which are rotated inside the cylinders by a common crankshaft. Each cylinder has a separate suction pipe. At least one of the suction pipes has a check valve which may be closed to unload the cylinder to which the suction pipe is connected. The check valve has a housing and a slider which can slide inside the housing between an open position and a closed position. The check valve may be closed by introduction of high-pressure refrigerant gas into the space beneath the slider to push it to the closed position when a cylinder is to be unloaded. In another form of the invention, the check valve is closed by a spring made of a shape-memory alloy and a heater for heating the spring above a prescribed temperature at which the allow changes shape. When a cylinder is to be unloaded, the heater is turned on, and the shape-memory alloy deforms into a shape such as to force the slide to the closed position. Lubricating oil may be provided to an unloaded cylinder.

14 Claims, 5 Drawing Sheets

LOW PRESSURE GAS

HIGHT PRESSURE GAS

MULTICYLINDER ROTARY COMPRESSOR

BACKGROUND OF THE INVENTION

This invention relates to a multicylinder rotary compressor for use in an air conditioner, a refrigerator, or the like. More particularly, it relates to a multicylinder rotary compressor in which capacity control can be performed by unloading one of the cylinders of the compressor.

In a cooling system such as an air conditioner or refrigerator, it is often necessary to adjust the capacity of the compressor of the cooling system in accordance with the load. The conventional method of capacity control is by turning the compressor motor on and off in response to some parameter such as the temperature in the space being cooled. However, if the cooling system employs only a single compressor, this method allows only very coarse adjustment of the capacity.

For a multicylinder rotary compressor having a plurality of cylinders which are driven by a single crankshaft, more refined capacity control can be performed by selectively stopping one or more of the cylinders of the compressor. In one form of rotary compressor, the crankshaft consists of a plurality of sections, each of which drives a different cylinder. The sections of the crankshaft are connected together by clutches, and by selectively engaging the clutches, a varying number of cylinders can be driven by the crankshaft, thereby varying the capacity of the compressor. However, a rotary compressor of this type has a more complicated structure than one with a one-piece crankshaft, which makes it more expensive to manufacture and less reliable.

A recently-proposed method of capacity control for a multicylinder rotary compressor with a one-piece crankshaft is the suction line cut-off method in which the suction line of one of the cylinders of the compressor is completely blocked. The pressure within the cylinder is reduced to substantially a vacuum, so that the cylinder is unloaded and the output thereof falls to zero.

SUMMARY OF THE INVENTION

It is an object of the present invention to provide a multicylinder rotary compressor in which capacity control can be performed by cut-off of the suction line to one of the cylinders of the compressor.

It is another object of the present invention to provide a multicylinder rotary compressor which can be obtained by making only small changes to the check valve of a conventional multicylinder rotary compressor.

A multicylinder rotary compressor in accordance with the present invention is of the rolling piston type having a plurality of rolling pistons which are housed in a corresponding number of cylinders which are disposed in parallel with one another. The rolling pistons are rotated inside the cylinders by a one-piece crankshaft which is driven by an electric motor. Each cylinder has a separate suction pipe connected thereto, and at least one of the suction pipes has a check valve installed along it. The check valve is equipped with means for closing the check valve against the suction of the cylinder with which it communicates, whereby the suction line to the cylinder is cut off and the cylinder is unloaded to reduce the capacity of the compressor.

In preferred embodiments, the check valve comprises a housing and a cylindrical slider which can slide inside the housing between a closed position, in which it closes the suction pipe to which the check valve is connected, and an open position, in which fluid is free to flow through the check valve. The slider is biased towards the closed position by a compression spring.

In one form of the present invention, the means for closing the check valve against the suction of the unloaded cylinder comprises means for introducing high-pressure refrigerant gas into the housing of the check valve so as to force the slider to the closed position. High-pressure refrigerant gas from a high-pressure portion of the cooling apparatus to which the compressor is connected is introduced into the housing via piping and a solenoid valve which can shut off flow through the piping. When the solenoid valve is opened, high-pressure refrigerant gas enters the housing and pushes the slider to the closed position.

In another form of the present invention, the means for closing the check valve comprises a biasing spring which is made of a shape-memory alloy which deforms above a prescribed temperature and a heater for heating the spring. The spring is disposed inside the housing of the check valve so as to bias the slider of the check valve towards the closed position, and the heater is disposed in the vicinity of the spring. When the spring is below the prescribed temperature, its shape is such that it biases the slider towards the closed position but enables the slider to open when the compressor is running. When the heater is turned on and the temperature of the spring rises above the prescribed temperature, it rapidly deforms to a shape which forces the slider to the closed position and cuts off the suction line to one of the cylinders of the compressor, thereby reducing the compressor capacity.

The compressor may be further equipped with lubricating means for lubricating the inside of an unloaded cylinder. In a preferred embodiment, the lubricating means comprises piping which connects the inside of the shell of the compressor with the inside of the suction pipe for the unloaded cylinder via a solenoid valve, and a venting passageway which enables a small quantity of refrigerant gas to flow past the check valve even when it is closed. Lubricating oil which is contained in the shell of the compressor is introduced into the suction pipe via the oil passageway and is entrained as a mist in the small flow of refrigerant which flows through the suction pipe via the venting passageway. The lubricating oil and the refrigerant gas lubricate and cool the unloaded cylinder and prevent excess wear of the reciprocating vane of the cylinder.

BRIEF DESCRIPTION OF THE DRAWINGS

In the drawings, the same reference numerals indicate the same or corresponding parts.

DESCRIPTION OF THE PREFERRED EMBODIMENTS

Figure 1:
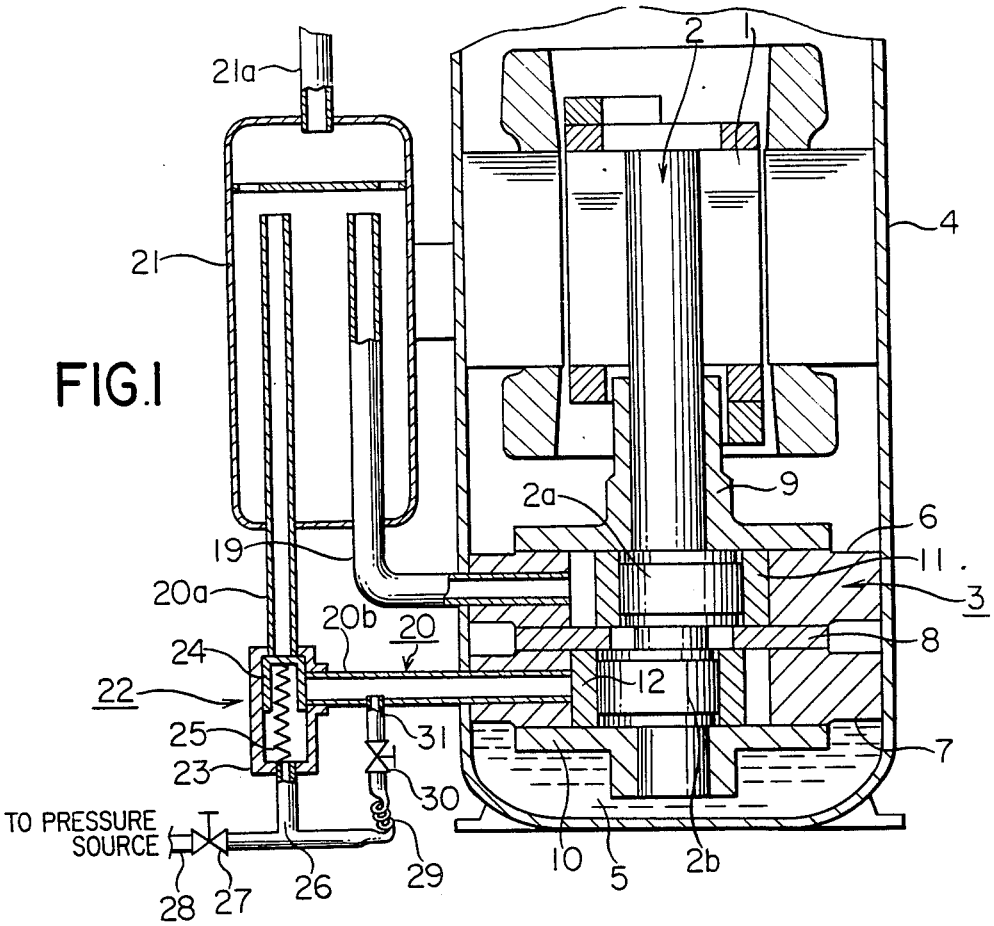
FIG. 1 is a vertical cross-sectional view of a first embodiment of a multicylinder rotary compressor in accordance with the present invention.

Hereinbelow, a number of preferred embodiments of a multicylinder rotary compressor in accordance with the present invention will be described while referring to the accompanying drawings. As shown in FIG. 1, which is a vertical cross-sectional view of a first embodiment, an electric motor 1 is drivingly connected to a compressor unit 3 by a crankshaft 2 which is secured to the rotor of the electric motor 1. The electric motor 1 and the compressor unit 3 are housed within and supported by a hermetically sealed shell 4. The bottom portion of the shell 4 serves as an oil sump and is filled with lubricating oil 5 for the compressor unit 3. The crankshaft 2 is journaled by an upper bearing 9 and a lower bearing 10, and axial loads on the crankshaft 2 are borne by the flat upper surface of the lower bearing 10. The compressor unit 3 has an upper cylinder 6 and a lower cylinder 7 which are disposed one above the other and are secured to the inner surface of the shell 4. The open ends of the cylinders are covered by the upper bearing 9 and the lower bearing 10, and the two cylinders are separated from one another by a partition 8 through which the crankshaft 2 passes. The crankshaft 2 has two eccentric lobes 2*a* and 2*b* formed thereon which are angularly separated from one another by 180 degrees with respect to the axis of the crankshaft 2. Two rolling pistons 11 and 12 loosely fit on the lobes 2*a* and 2*b*, respectively, so as to be able to freely rotate on the lobes. When the crankshaft 2 is rotated, the rolling pistons 11 and 12 roll along the inner surfaces of the cylinders 6 and 7, respectively.

Figure 2:
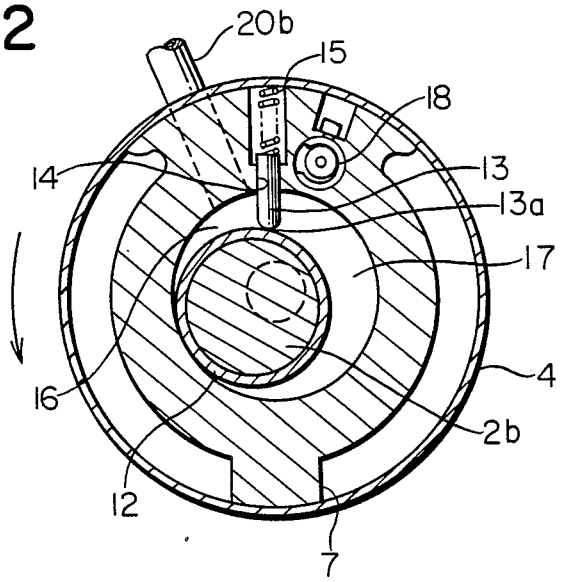
FIG. 2 is a horizontal cross-sectional view of the lower cylinder of the compressor of FIG. 1.

As shown in FIG. 2, which is a horizontal cross-sectional view of the lower cylinder 7 of FIG. 1, the inside of each cylinder is divided into a suction chamber 16 and a compression chamber 17 by a reciprocating vane 13 which is slidingly disposed in a bore 14 formed in the wall of the cylinder. The tip 13*a* of the vane 13 is pressed against the outer surface of the rolling piston 12 by a compression spring 15 which is housed within the bore 14 to the rear of the vane 13. A spring-loaded discharge valve 18 which is housed within the wall of the cylinder 7 communicates with the inside of the compression chamber 17. The upper cylinder 6 has a similar structure.

An upper suction pipe 19 and a lower suction pipe 20 are connected between an accumulator 21 and the suction chambers 16 of the upper and lower cylinders 6 and 7, respectively. The accumulator 21 has an intake pipe 21*a* which is connected to the low-pressure side of an unillustrated cooling apparatus such as an air conditioner or a refrigerator into which the compressor is incorporated, while the discharge valves 18 of the cylinders communicate with an unillustrated discharge pipe which is connected to the high-pressure side of the cooling apparatus. The lower suction pipe 20 is divided into an upstream portion 20*a* and a downstream portion 20*b* between which a check valve 22 is connected. The check valve 22 has a cylindrical housing 23 inside which a hollow cylindrical slider 24 having a closed top and an open bottom is slidably disposed. The slider 24 can slide between a closed position, shown in FIG. 1, in which the top surface of the slider 24 blocks the upstream portion 20*a* and its side surface blocks the downstream portion 20*b* of the lower suction pipe 20, and an open position in which fluid can pass freely through the check valve 22. The slider 24 is biased towards the closed position by a compression spring 25 which is disposed inside the housing 23 beneath the slider 24.

One leg of a T-shaped connecting pipe 26 opens onto the inside of the housing 23 of the check valve 22 below the slider 24. Another leg of the connecting pipe 26 is connected to a high-pressure portion of the unillustrated cooling apparatus in which the compressor is installed through a supply pipe 28 and a solenoid valve 27 which is connected between the connecting pipe 26 and the supply pipe 28. When the solenoid valve 27 is opened, high-pressure refrigerant is introduced into the space below the slider 24 within the housing 23. The connecting pipe 26, the solenoid valve 27, and the supply pipe 28 constitute means for closing the check valve 22 so as to cut off the suction line for the lower cylinder 7.

The third leg of the connecting pipe 26 is connected to the downstream portion 20*b* of the lower suction pipe 20 via a capillary tube 29, a solenoid valve 30, and a venting pipe 31 which are connected in series. When solenoid valve 30 is opened, the inside of the downstream portion 20*b* of the lower suction pipe 20 can communicate with the inside of the housing 23 even when the slider 24 is in the closed position.

The operation of the compressor of FIG. 1 will now be described. When the electric motor 1 is turned on, the crankshaft 2 is rotated by the motor 1, and the eccentric lobes 2*a* and 2*b* rotate about the inside of the cylinders 6 and 7 in the counterclockwise direction as shown by the arrow in FIG. 2. The rolling pistons 11 and 12, which are free to rotate on the eccentric lobes 2*a* and 2*b*, roll along the inner surfaces of the cylinders 6 and 7. The motion of the rolling pistons produces a progressive increase in the size of the suction chambers 16, which causes refrigerant gas to be sucked into the cylinders 6 and 7 through the suction pipes 19 and 20, respectively. At the same time, the motion of the rolling pistons produces a progressive decrease in the size of the compression chamber 17, as a result of which refrigerant gas which was sucked into the suction chambers 16 during the previous rotation of the crankshaft 2 is compressed in the compression chambers 17. When the compressed refrigerant gas reaches a certain pressure, it pushes open the discharge vales 18 and is discharged from the cylinders 6 and 7 into the sealed shell 4, from which it is led to other portions of the cooling apparatus by unillustrated piping.

Figure 3:
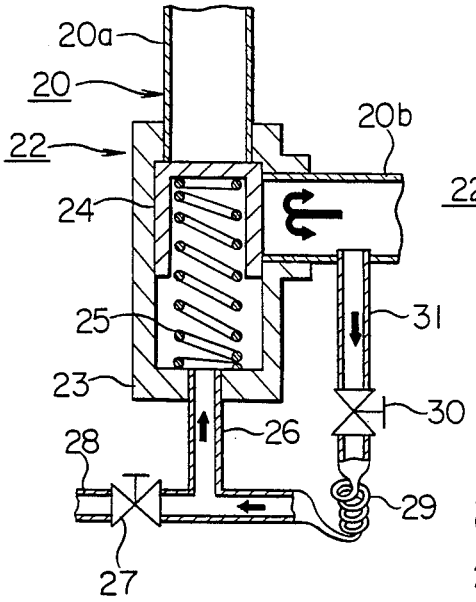
FIGS. 3*a*–3*c* are enlarged vertical cross-sectional views of the check valve of the embodiment of FIG. 1, illustrating different modes of operation.
Figure 3:
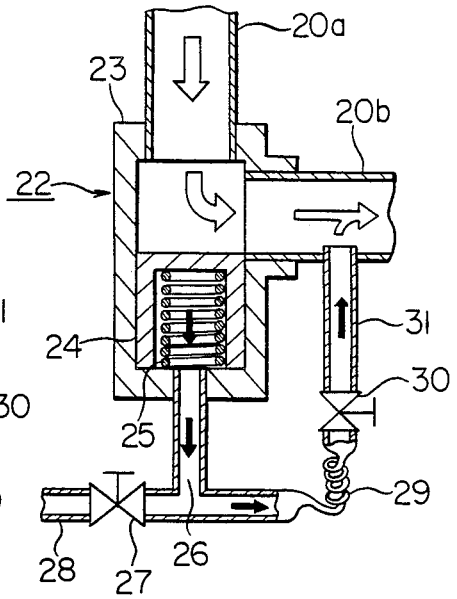
Figure 3:
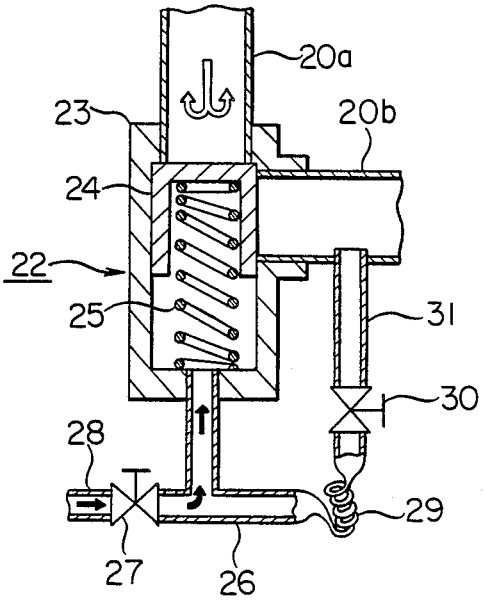

The operation of the check valve 22 is illustrated in FIGS. 3*a*–3*c*, in which the solid arrows indicate flow of high-pressure refrigerant gas and the hollow arrows indicate flow of low-pressure refrigerant gas. During normal operation with both cylinders producing compression, solenoid valve 27 is closed and solenoid valve 30 is open, so that the space within the housing 23 below the slider 24 communicates with the inside of the downstream portion 20*b* of the lower suction pipe 20. Before the compressor is started, the biasing spring 25 pushed the slider 24 upwards to the closed position, as shown in FIG. 3*a*. When the compressor begins to operate, since solenoid valve 30 is open, the suction produced in the lower cylinder 7 produces a drop in the pressure in the space beneath the slider 24 of the check valve 22. As a result, the slider 24 is pulled downwards against the biasing force of the biasing spring 25 and is moved to the open position, as shown in FIG. 3*b*, and low-pressure refrigerant gas to be compressed is drawn into the lower cylinder 7 through the check valve 22.

When the compressor stops, due to the pressure difference between the high-pressure refrigerant gas within the compression chambers 17 and the low-pressure refrigerant gas within the suction chambers 16, a clockwise torque is exerted on the crankshaft 2. As a downwards force is no longer exerted on the slider 24 of the check valve 22, the biasing spring 25 moves the slider 24 upwards to the closed position of FIG. 3*a*. Therefore, the pressure within the suction chambers 16 gradually reaches a level equal to that in the compression chamber 17, and the reverse rotation of the crankshaft 2 is prevented.

When it is desired to lower the capacity of the compressor by unloading the lower cylinder 7, solenoid valve 30 is closed and solenoid valve 27 is opened. Opening solenoid valve 27 introduces high-pressure refrigerant gas from a high-pressure portion of the cooling apparatus into the portion of the housing 23 below the slider 24, and this high-pressure refrigerant gas pushes the slider 24 into the closed position, cutting off the suction line to the lower cylinder 7. As a result, the lower cylinder 7 is unloaded, the inside of the lower cylinder 7 is reduced to substantially a vacuum, and refrigerant gas is sucked only into the upper cylinder 6, whereby the capacity of the compressor is halved. To return to normal full-capacity operation, solenoid valve 27 is closed and solenoid valve 30 is opened, whereby the slider 24 is free to move between the open and closed position in accordance with the suction in the downstream portion 20*b* of the lower suction pipe 20.

It is possible to provide a check valve 22 like the one shown in FIG. 1 along either the upper suction pipe 19 or the lower suction pipe 20 and perform capacity control by unloading either the upper cylinder 6 or the lower cylinder 7. However, it is preferable to perform capacity control by unloading the lower cylinder 7 rather than the upper cylinder 6, since when the lower cylinder 7 is unloaded, the load is applied to the upper end of the crankshaft 2, which has a large load capacity. Therefore, there is a lesser likelihood of the bearings 9 and 10 seizing up than if the upper cylinder 6 is unloaded.

Figure 4:
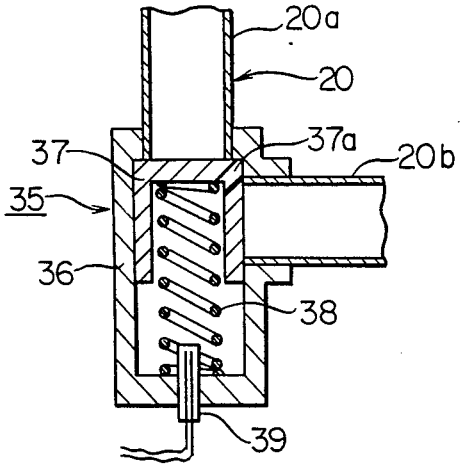
FIG. 4 is an enlarged vertical cross-sectional view of a check valve of a second embodiment of the present invention.

FIG. 4 illustrates a check valve 35 of a second embodiment of the present invention. The check valve 35 has a cylindrical housing 36 in which a cylindrical slider 37 is slidably disposed, and the housing 36 is connected to an unillustrated accumulator and the suction chamber of an unillustrated lower cylinder by a lower suction pipe 20 in the same manner as in the previous embodiment. The slider 37 of the check valve 35 is biased towards a closed position by a biasing spring 38 which is made of a shape-memory alloy which suddenly changes its shape when it exceeds a prescribed temperature and forces the slider 37 into the closed position. An electric heater 39 for heating the biasing spring 38 above the prescribe temperature is installed in the floor of the housing 36 in the vicinity of the biasing spring 38. The biasing spring 38 and the heater 39 serve as means for closing the check valve 35 against the suction of the lower cylinder so as to cut off the suction line to the lower cylinder and unload it. A small venting hole 37*a* is formed in the side of the slider 37, by means of which the inside of the slider 37 communicates with the inside of the downstream portion 20*b* of the lower suction pipe 20 when the slider 37 is forced to slightly displaced downwards so that the gas inside the housing 36 can escape toward the lower suction pipe downstream portion 20*b* through the venting hole 37. With the exception of the check valve 35, the structure of this embodiment is otherwise identical to that of the embodiment of FIG. 1.

During normal operation of this embodiment with both cylinders producing compression, the electric heater 39 is off, and the biasing spring 38 functions in the same manner as the biasing spring 25 of FIG. 1. Namely, when the compressor is off, the slider 37 is pushed upwards by the biasing spring 38 to the closed position shown in FIG. 4, and when the compressor is running, the suction produced by the lower cylinder 7 overcomes the force of the biasing spring 38 and draws the slider 37 downwards to an open position. When it is desired to unload the lower cylinder, the heater 39 is turned on. The temperature of the biasing spring 38 is thereby raised to the prescribed temperature, and it rapidly deforms to a shape in which it forces the slider 37 upwards to the closed position and blocks the lower suction pipe 20. As long as the heater 39 is switched on, the slider 37 remains in the closed position. The operation of this embodiment is otherwise the same as that of the preceding embodiment.

In order to enable the slider to smoothly slide up and down inside the housing of the check valve, there must be a small gap between the outer surface of the slider and the inner surface of the housing. In the embodiment of FIG. 1, this small gap allows high-pressure refrigerant gas which is introduced into the housing 23 via solenoid valve 27 to leak past the slider 24 into the lower suction pipe 20. From the lower suction pipe 20, the refrigerant gas is sucked into the lower cylinder 7 and recompressed, resulting in excess power consumption and a decrease in compresor efficiency.

The leakage of high-pressure gas into the downstream portion 20*b* of the lower suction pipe 20 can be somewhat reduced by making the slider 24 of a material having a larger coefficient of thermal expansion than the housing 23. In this case, the heat of the high-pressure refrigerant gas which is introduced into the housing 23 will cause the slider 24 to expand more than the housing 23, decreasing the size of the gap therebetween and reducing the leakage. However, as a gap between the slider and the housing is necessary for the operation of the check valve, leakage can not be entirely prevented by this method.

Figure 5:
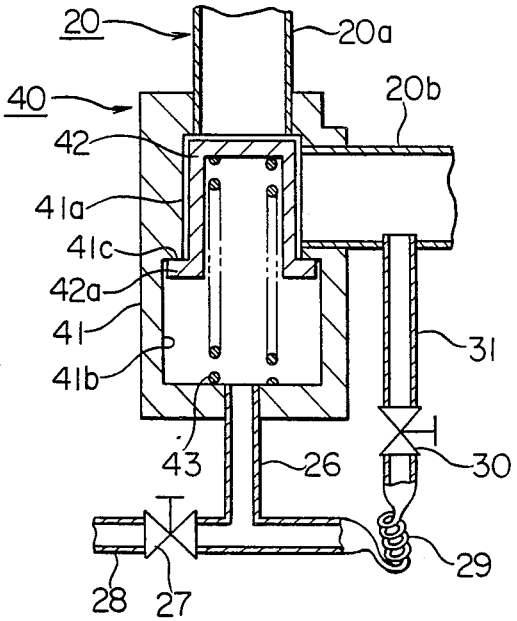
FIG. 5 is an enlarged vertical cross-sectional view of a check valve of a third embodiment of the present invention.

FIG. 5 illustrates a check valve 40 of a third embodiment of the present invention in which such leakage of high-pressure refrigerant gas into an unloaded cylinder can be prevented. The check valve 40 has a cylindrical housing 41 in which a cylindrical slider 42 is slidably disposed. The slider 42 has an outwardly-extending flange 42*a* shaped like a sword guard formed along the periphery of its lower end. The slider 42 is biased towards a closed position in which it blocks the upstream and downstream portions of a lower suction pipe 20 by a biasing spring 43 which is disposed inside the housing 41 beneath the slider 42. The hollow inside portion of the housing 41 of the check valve 40 consists of a small-diameter portion 41*a* whose diameter is slightly larger than that of the upper portion of the slider 42, and a large-diameter portion 41*b* whose diameter is slightly larger than that of the flange 42*a*. The upper portion of the slider 42 is slidably disposed within the small-diameter portion 41*a*, and the flange 42*a* of the slider 42 is slidably disposed inside the large-diameter portion 41*b*. A square-edge step 41*c* is formed in the inner surface of the housing 41 between the small-diameter portion 41*a* and the large-diameter portion 41*b*. The distance from the top surface of the flange 42*a* to the top surface of the slider 42 is slightly less than the height of the small-diameter portion 41*a* so that when the slider 42 is in a closed position, the top surface of the flange 42*a* will be pressed firmly against the step 41c, thereby forming an airtight seal. Thus, even though there is still a gap between the outer surface of the slider 42 and the inner surface of the housing 41, high-pressure gas which is introduced into the housing 41 via supply pipe 28 and solenoid valve 27 is prevented from leaking past the slider 42 into the downstream portion 20*b* of the lower suction pipe 20. This embodiment is otherwise identical to the embodiment of FIG. 1.

Figure 6:
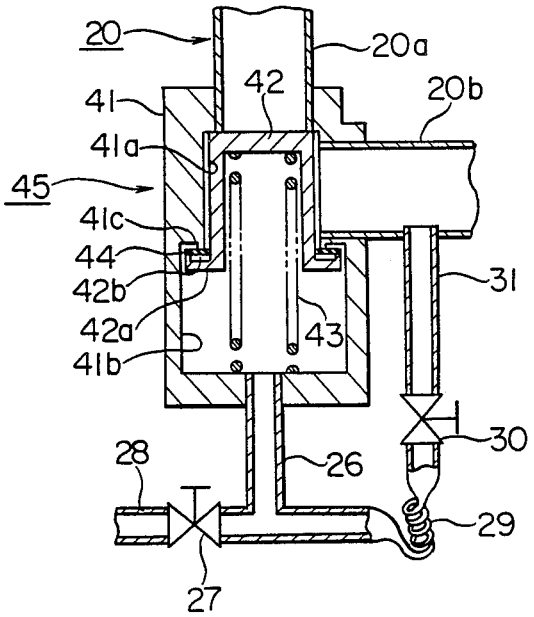
FIG. 6 is an enlarged vertical cross-sectional view of a check valve of a fourth embodiment of the present invention.

FIG. 6 illustrates a check valve 45 of a fourth embodiment of the present invention. As in the previous embodiment, a slider 42 has a flange 42*a* formed on the lower end thereof, but in this embodiment, the flange 42*a* has an annular relief groove 42*b* formed in its top surface, and the relief groove 42*b* is covered by a ring 44 of an elastic material which is secured to the top surface of the flange 42*a* by bonding. The housing 41 in which the slider 42 is disposed has a small-diameter portion 41*a* and a large-diameter portion 41*b* in which the upper portion of the slider 42 and the flange 42*a* thereof, respectively, are slidably disposed. A narrow step 41*c* protrudes slightly from the top surface of the large-diameter portion 41*b*. When the slider 42 is in a closed position as shown in FIG. 6, the elastic ring 44 is pressed firmly against the step 41*c* and deforms slightly into the relief groove 42*b*, ensuring an airtight seal between the flange 42*a* and the step 41*c* even when the confronting surfaces of the flange 42*a* and step 41*c* are not completely smooth. This embodiment is otherwise identical to the embodiment of FIG. 1. The same effects canbe obtained by forming a relief groove in the step 41*c* instead of in the flange 42*a* and covering it with a ring of an elastic material.

Figure 7:
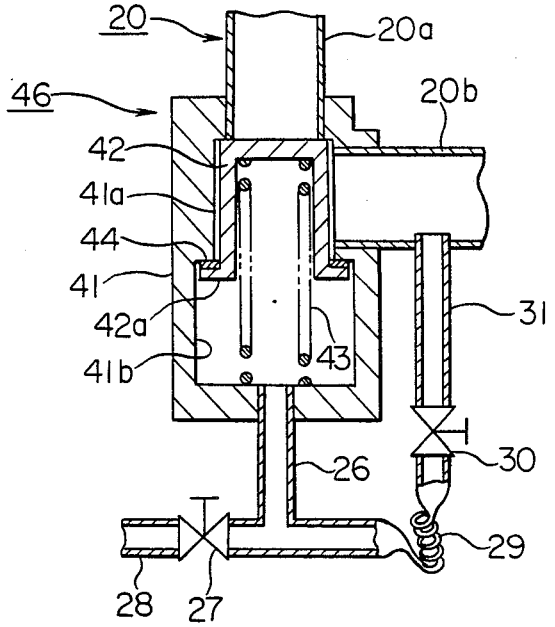
FIG. 7 is an enlarged vertical cross-sectional view of a check valve of a fifth embodiment of the present invention.

FIG. 7 illustrates a check valve 46 of a fifth embodiment of the present invention which differs from the check valve 45 of FIG. 5 only in that a ring 44 of an elastic material is secured to the top surface of a flange 42*a* by bonding, Thus ensuring an airtight seal between the flange 42*a* and the step 41*c* of the housing 41. The elastic ring 44 is made of a heat-resistant material such as a fluoroplastic. The same effects can be obtained by bonding a ring of an elastic material to the bottom surface of the step 41*c* instead of to the flange 42*a*. The operation of this embodiment is the same as that of the embodiment of FIG. 1.

In the embodiments of FIGS. 5–7, because there is a small gap between the top surface of the slider 42 and the top surface of the housing 41 of the check valve, a small quantity of refrigerant gas leaks through this gap into the lower cylinder 7. However, as this is low-pressure gas from the accumulator 21, it has substantially no effect on the efficiency of the compressor.

During normal operation when both cylinders are loaded, low-temperature lubricating oil 5 from the inside of the shell 4 of the compressor is entrained in the form of a mist in the low-temperature refrigerant gas which is sucked into the cylinders 6 and 7. This mist of lubricating oil 5 lubricates the outer surfaces of the rolling pistons 11 and 12 and the tips 13*a* of the vanes 13 and helps to cool them. However, when the check valve on the lower suction pipe 20 is closed and the lower cylinder 7 is unloaded, no lubricating oil 5 can enter the lower cylinder 7. Furthermore, when the lower cylinder 7 is unloaded, the pressure of the tip 13*a* of the vane 13 against the outer surface of the rolling piston 12 in the lower cylinder 7 is increased due to the near vacuum in the suction chamber 16 of the lower cylinder 7 which results from the closing of the check valve. Accordingly, the wear of the tip 13*a* of the vane 13 of the lower cylinder 7 increases, causing increased power consumption, lower efficiency at times of full load, and decreased reliability.

Figure 9:
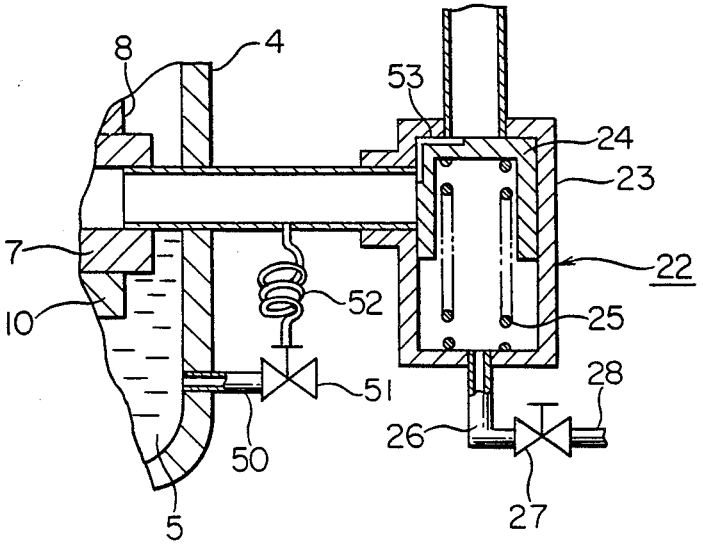
FIG. 9 is an enlarged vertical cross-sectional view of an oil supply piping of the embodiment of FIG. 8.
Figure 8:
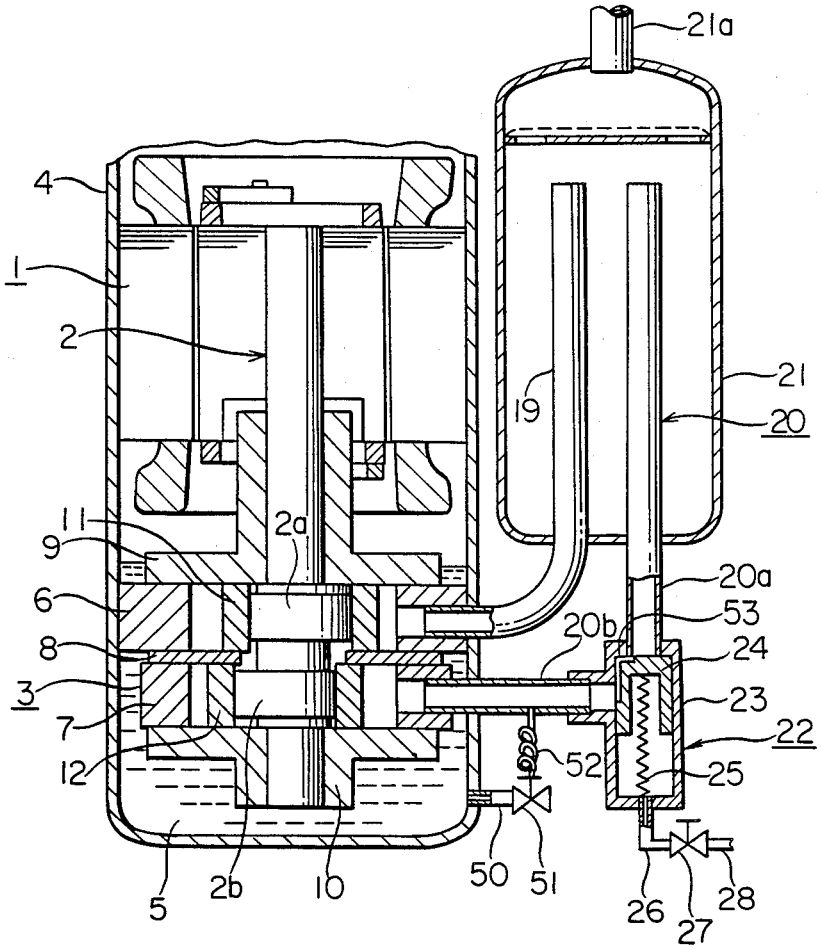
FIG. 8 is a vertical cross-sectional view of a sixth embodiment of the present invention.

This problem is solved in a sixth embodiment of the present invention, which is illustrated in cross section in FIGS. 8 and 9. The overall structure of this embodiment is similar to that of the embodiment of FIG. 1, but it is further equipped with means for lubricating and cooling an unloaded cylinder. The means for lubricating and cooling comprises a solenoid valve 51, an oil supply pipe 50 which is connected between the solenoid valve 51 and the inside of the shell 4 below the surface of the lubricating oil 5, a capillary tube 52 which is connected between the solenoid valve 51 and the inside of the downstream portion 20*b* of the lower suction pipe 20, and a small passageway 53 which extends between the top surface and the side wall of the slider 24 of a check valve 22. The passageway 53 opens onto both the upstream portion 20a and the downstream portion 20*b* of a lower suction pipe 20 when the slider 24 is in a closed position.

During normal operation when both cylinders are loaded, solenoid valve 51 is closed, and the lower cylinder 7 is lubricated by lubricating oil 5 which is entrained in refrigerant gas circulating through the cooling apparatus. When the slider 24 is moved to the closed position to unload the lower cylinder 7, solenoid valve 51 is opened. A minute quantity of low-temperature refrigerant gas from the upstream portion 20a of the lower suction pipe 20 passes through the small passageway 53 in the slider 24 and is sucked into the suction chamber 16 of the lower cylinder 7. Lubricating oil 5 from the inside of the shell 4 is sucked into the lower suction pipe 20 through the oil supply pipe 50, solenoid valve 51, and the capillary tube 52 and is entrained in the form of a mist in the refrigerant gas being sucked through the small passageway 53. The mixture of low-temperature refrigerant gas and lubricating oil 5 lubricates and cools the tip 13*a* of the vane 13 of the lower cylinder 7 so that the vane 13 is prevented from being worn. The operation of this embodiment is otherwise the same as that of the embodiment of FIG. 1.

The small amount of refrigerant gas which is sucked into the lower cylinder 7 through the small passageway 53 is compressed in the lower cylinder 7 and discharged, increasing the capacity of the compressor. However, the increase in capacity is extremely slight, and as the compressor is cooled by this small flow of refrigerant gas, the efficiency of the compressor is increased.

In this embodiment, with the exception of the provision of the small passageway 53, the check valve 22 has the same structure as that of the embodiment of FIG. 1. However, if a passageway 53 is added thereto, a check valve like that employed in any of the other embodiments can instead be used.

What is claimed is:

1. A multicylinder rotary compressor for a cooling apparatus comprising:

a plurality of cylinders which are disposed in parallel with one another;

a crankshaft which extends through said cylinders and which has a plurality of eccentric cylindrical lobes formed thereon, each of said eccentric cylindrical lobes being disposed inside one of said cylinders;

a plurality of rolling pistons, each of which loosely fits on one of said eccentric cylindrical lobes so as to rotate thereon and is in rolling contact with the inner surface of one of said cylinders;

an electric motor to which said crankshaft is connected so as to be rotatable thereby;

a plurality of reciprocating vanes, each of which is slidably disposed inside the wall of one of said cylinders with one end in sliding contact with the outer surface of one of said rolling pistons, each vane dividing the inside of the cylinder in which it is disposed into a suction chamber and a compression chamber;

a plurality of suction pipes, each of which opens onto the inside of the suction chamber of one of said cylinders;

a check valve which is connected to one of said suction pipes and divides it into an upstream portion and a downstream portion which opens onto the inside of the suction chamber of one of said cylinders;

means for biasing said check valve to a closed condition with such force as to close said valve when the compressor is not running and allow said valve to open in response to suction pressure when said compressor is running; and means for closing said check valve against the suction of the cylinder to which said downstream portion is connected while the compressor is running to unload said cylinder and reduce the capacity of the compressor.

2. A multicylinder rotary compressor as claimed in claim 1 further comprising:

a sealed shell which encloses said motor and said cylinders;

lubricating oil which is disposed in the bottom of said sealed shell; and oil supply means for supplying said lubricating oil to the cylinder to which said downstream portion is connected when said check valve is closed by said closing means.

3. A multicylinder rotary compressor as claimed in claim 1 wherein:

said check valve comprises a cylindrical housing which is connected between said upstream portion and said downstream portion, a cylindrical slider which is slidable back and forth within said housing between an open position in which fluid is able to pass between said upstream portion and said downstream portion and a closed position in which fluid is prevented from passing between said upstream portion and said downstream portion; and said closing means for closing said check valve comprises a biasing spring which is made of a shape-memory alloy which deforms above a prescribed temperature into a shape such that said biasing spring pushes said slider to said closed position and maintains said slider in said closed position against the suction in said downstream portion, and a heater which is disposed in the vicinity of said biasing spring.

4. A multicylinder rotary compressor as claimed in claim 3 wherein a passageway which communicates between the inside of said housing and said downstream portion of the suction pipe to which said check valve is connected is formed in the wall of said slider.

5. A multicylinder rotary compressor as claimed in claim 1 wherein:

said check valve comprises a cylindrical housing which is connected between said upstream portion and said downstream portion, a cylindrical slider which is slidable back and forth within said housing between an open position in which fluid is able to pass between said upstream portion and said downstream portion, and a closed position in which fluid is prevented from passing between said upstream portion and said downstream portion; and said closing means comprises means for introducing high pressure gas into said housing to the rear of said slider.

6. A multicylinder rotary compressor as claimed in claim 5 wherein said means for introducing high-pressure gas into said housing comprises:

piping which is connected between a high-pressure portion of said cooling apparatus and the inside of said housing of said check valve; and a solenoid valve which is connected along said piping.

7. A multicylinder rotary compressor as claimed in claim 5 further comprising venting means for enabling gas to pass between the inside of said downstream portion of said suction pipe and the inside of said housing of said check valve.

8. A multicylinder rotary compressor as claimed in claim 5 wherein said slider is made of a material having a larger coefficient of thermal expansion than said housing.

9. A multicylinder rotary compressor for a cooling apparatus comprising:

a plurality of cylinders which are disposed in parallel with one another;

a crankshaft which extends through said cylinders and which has a plurality of eccentric cylindrical lobes formed thereon, each of said eccentric cylindrical lobes being disposed inside one of said cylinders;

a plurality of rolling pistons, each of which loosely fits on one of said eccentric cylindrical lobes so as to rotate thereon and is in rolling contact with the inner surface of one of said cylinders;

an electric motor to which said crankshaft is connected so as to be rotatable thereby;

a plurality of reciprocating vanes, each of which is slidably disposed inside the wall of one of said cylinders with one end in sliding contact with the outer surface of one of said rolling pistons, each vane dividing the inside of the cylinder in which it is disposed into a suction chamber and a compression chamber;

a plurality of suction pipes, each of which opens onto the inside of the suction chamber of one of said cylinders;

a check valve which is connected to one of said suction pipes and divides it into an upstream portion and a downstream portion which opens onto the inside of the suction chamber of one of said cylinders, said check valve comprising a cylindrical housing which is connected between said upstream portion and said downstream portion, a cylindrical slider which is slidable back and forth within said housing between an open position in which fluid is able to pass between said upstream portion and said downstream portion, and a closed position in which fluid is prevented from passing between said upstream portion and said downstream;

means for biasing said check valve to a closed condition with such force as to close said valve when the compressor is not running and allow said valve to open in response to suction pressure when said compressor is running;

means for closing said check valve against the suction of the cylinder to which said downstream portion is connected while the compressor is running to unload said cylinder and reduce the capacity of the compressor;

said closing means comprising means for introducing high pressure gas into said housing to the rear of said slider; and venting means for enabling gas to pass between the inside of said downstream portion of said suction pipe and the inside of said housing of said check valve, said venting means comprising a solenoid valve, a pipe which is connected between one end of said solenoid valve and the inside of said housing, and a capillary tube which is connected between the other end of said solenoid valve and the inside of the downstream portion of the suction pipe to which said check valve is connected.

10. a multicylinder rotary compressor for a cooling apparatus comprising:

a plurality of cylinders which are disposed in parallel with one another;

a crankshaft which extends through said cylinders and which has a plurality of eccentric cylindrical lobes formed thereon, each of said eccentric cylindrical lobes being disposed inside one of said cylinders;

a plurality of rolling pistons, each of which loosely fits on one of said eccentric cylindrical lobes so as to rotate thereon and is in rolling contact with the inner surface of one of said cylinders;

an electric motor to which said crankshaft is connected so as to be rotatable thereby;

a plurality of reciprocating vanes, each of which is slidably disposed inside the wall of one of said cylinders with one end in sliding contact with the outer surface of one of said rolling pistons, each vane dividing the inside of the cylinder in which it is disposed into a suction chamber and a compression chamber;

a plurality of suction pipes, each of which opens onto the inside of the suction chamber of one of said cylinders;

a check valve which is connected to one of said suction pipes and divides it into an upstream portion and a downstream portion which opens onto the inside of the suction chamber of one of said cylinders, said check valve comprising a cylindrical housing which is connected between said upstream portion and said downstream portion, a cylindrical slider which is slidable back and forth within said housing between an open position in which fluid is able to pass between said upstream portion and said downstream portion, and a closed position in which fluid is prevented from passing between said upstream portion and said downstream portion;

means for biasing said check valve to a closed condition with such force as to close said valve when the compressor is not running and allow said valve to open in response to suction pressure when said compressor is running;

means for closing said check valve against the suction of the cylinder to which said downstream portion is connected while the compressor is running to unload said cylinder and reduce the capacity of the compressor, said closing means comprising means for introducing high pressure gas into said housing to the rear of said slider, said housing having a small-diameter portion with a cylindrical bore which opens onto the inside of said upstream and downstream portions of the suction pipe to which said check valve is connected, a large-diameter portion with a cylindrical bore which is larger than that of said small-diameter portion, and a step formed on the top surface of said large-diameter portion;

said slider having an outwardly-extending flange formed on the bottom end thereof, the distance from the top surface of said flange to the top surface of said slider being less than the axial length of said small-diameter portion;

the top portion of said slider being slidably disposed in said small-diameter portion and said flange being slidably disposed in said large-diameter portion, the top surface of said flange abutting against said step when said slider is in said closed position.

11. A multicylinder rotary compressor as claimed in claim 10 further comprising an elastic material which is secured to one of the abutting surfaces of said flange and said step.

12. A multicylinder rotary compressor as claimed in claim 11 wherein said surface to which said elastic material is secured has an annular relief groove formed therein, said elastic material covering said relief groove.

13. A multicylinder rotary compressor as claimed in claim 11 wherein said elastic material is a heat-resistant fluroplastic.

14. A multicylinder rotary compressor for a cooling apparatus comprising:

a plurality of cylinders which are disposed in parallel with one another;

a crankshaft which extends through said cylinders and which has a plurality of eccentric cylindrical lobes formed thereon, each of said eccentric cylindrical lobes being disposed inside one of said cylinders;

a plurality of rolling pistons, each of which loosely fits on one of said eccentric cylindrical lobes so as to rotate thereon and is in rolling contact with the inner surface of one of said cylinder;

an electric motor to which said crankshaft is connected so as to be rotatable thereby;

a plurality of reciprocating vanes, each of which is slidably disposed inside the wall of one of said cylinders with one end in sliding contact with the outer surface of one of said rolling pistons, each vane dividing the inside of the cylinder in which it is disposed into a suction chamber and a compression chamber;

a plurality of suction pipes, each of which opens onto the inside of the suction chamber of one of said cylinders;

a check valve which is connected to one of said suction pipes and divides it into an upstream portion and a downstream portion which opens onto the inside of the suction chamber of one of said cylinders;

means for biasing said check valve to a closed condition with such force as to close said valve when the compressor is not running and allow said valve to open in response to suction pressure when said compressor is running;

means for closing said check valve against the suction of the cylinder to which said downstream portion is connected while the compressor is running to unload said cylinder and reduce the capacity of the compressor;

a sealed shell which encloses said motor and said cylinders;

lubricating oil which is disposed in the bottom of said sealed shell;

oil supply means for supplying said lubricating oil to the cylinder to which said downstream portion is connected when said check valve is closed by said closing means;

said oil supply means comprising a solenoid valve, a pipe which is connected between one end of said solenoid valve and the inside of said bottom portion of said shell beneath the surface of said lubricating oil, a capillary tube which is connected between said solenoid valve and the inside of said downstream portion of the suction pipe to which said check valve is connected, and a small passageway which is formed in said slider and which opens onto said upstream and downstream portions when said slider is in said closed position.

* * * * *